United States Patent [19]

Fletcher

[11] Patent Number: 4,567,875

[45] Date of Patent: Feb. 4, 1986

[54] BOWSTRING RELEASE DEVICE

[76] Inventor: James D. Fletcher, P.O. Box 218, Bodfish, Calif. 93205

[21] Appl. No.: 675,382

[22] Filed: Nov. 26, 1984

Related U.S. Application Data

[62] Division of Ser. No. 401,028, Jul. 22, 1982, Pat. No. 4,498,440.

[51] Int. Cl.[4] ..... F41C 19/00

[52] U.S. Cl. ..... 124/35 A

[58] Field of Search ..... 124/35 R, 35 A

[56] References Cited

U.S. PATENT DOCUMENTS

| | | | |
|---|---|---|---|
| 1,768,944 | 7/1930 | Taylor | 124/35 R |
| 4,156,417 | 5/1979 | Fletcher | 124/35 A |
| 4,308,851 | 1/1982 | Kaine et al. | 124/35 A |

*Primary Examiner*—Richard C. Pinkham
*Assistant Examiner*—Benjamin Layno
*Attorney, Agent, or Firm*—Donald E. Nist

[57] ABSTRACT

An improved mechanical bowstring release device automatically biased to the locked position comprises a hollow, preferably generally cylindrical housing having a central space along the length thereof and a bowstring retainer bar pivotally secured to the housing in the space. A string-retaining end of the bar extends into an opening in the front end of the housing. The bar also includes an opposite coupling end. The bar is pivotable between a bowstring-drawing locked position and a bowstring-releasing unlocked position. An elongated lever arm extends longitudinally of and is pivoted in the housing space, the rear portion thereof extending rearwardly of the housing, the front end thereof being adjacent and generally rearward of the retainer coupling end. One or more couplers connect the front end of the lever arm and the coupling end of the bar. A biasing spring automatically urges the front end of the arm into a position which locks the bar. Finger pressure against the arm rear end results in pivoting of that arm front end to cause movement of the couplers and bar coupling end to cause the bar to pivot into the unlocked string-releasing position. A retainer limit component is also present to prevent rotation of the retainer bar to an unlocked position unbiased by the biasing spring toward the locked position.

5 Claims, 4 Drawing Figures

BOWSTRING RELEASE DEVICE

This is a division, of application Ser. No. 06/401,028, filed 7/22/82 now U.S. Pat. No. 4,498,440.

BACKGROUND OF THE INVENTION

1. Field of the Invention

The present invention generally relates to sports equipment and more particularly to an improved archery bowstring release device.

2. Prior Art

Various types of mechanical archery bowstring release devices have been developed to improve shooting accuracy. The hook or ledge type is very popular. It usually involves a simple metallic or plastic hand-held ring or the like with a hooked projection adapted to engage the bowstring at a single location. When the bowstring is fully drawn and the bow has been fully aimed, the archer turns the ring or allows it to rotate so that the bowstring suddenly slips off the projection and is released. With such a device it is somewhat difficult to exactly reproduce the angle and movements relating to the draw and release from shot-to-shot. Moreover, there is a danger that during the draw, the archer will inadvertently allow the device to slip, prematurely firing the arrow.

So-called rope releases are more desirable in this respect since they usually involve a more or less slip-proof rope retainer. Moreover, the ropes which wrap around and are used to draw the bowstring dampen undesired inaccuracy-producing bowstring vibrations during release of the bowstring. However, in order to release the bowstring from most rope releases, certain hand movements are necessary which are difficult to reproduce from shot-to-shot.

So-called complex trigger-type releases reduce the hand movements which are necessary to trigger the release of the bowstring but are either so complicated and expensive to make so as to be of doubtful use to the average archer or are subject to substantial wear in use, due to the substantial force imposed on the sear elements of the trigger. An improved type of mechanical bowstring release device is set forth in U.S. Pat. No. 4,156,417 issued to the present inventor on May 29, 1979. Although that device is a substantial advance in the art, it still has certain deficiencies relating to the ultimate smoothness and feel of the trigger pull, the ability to easily adjust the trigger pull to a fine degree and the safety locking ability of the device.

Accordingly, it would be desirable to be able to provide an improved release device which would be capable of further promoting increased shooting accuracy with a high degree of safety and which would be capable of being fine tuned with respect to the trigger feel and for firing the device with a minimum of hand movement. Preferably such a device could also be used with or without a rope release assist.

It would also be of substantial importance to be able to provide a release device which could be rapidly locked to and unlocked from the bowstring, most preferably while only one hand manipulates the release device. Such a release device would be of great utility for hunting situations, where it is often necessary to load an arrow, draw and shoot the quarry in a very short time without previous warning. In many such instances, one hand may be needed to hold the arrow in place on the bow so that only one hand can be used to lock the release device to the bowstring. Unfortunately, release devices which feature pivotable bowstring retainer bars are designed such that when the retainer bar is in the unlocked position it pivots freely, requiring one hand to hold the release device and the other to move the retainer bar into the locked position.

SUMMARY OF THE INVENTION

The present invention satisifes all the foregoing needs. It is inexpensive, durable, subject to little wear, highly accurate and capable of being used in two different shooting modes, as desired by the archer. Moreover, it can easily and rapidly be locked to a bowstring with one hand in a positive manner which facilitates its use for hunting purposes. It is substantially as set forth in the Abstract above. The bowstring retainer bar when locked holds the bowstring itself or holds a rope which holds the bowstring so that the bowstring cannot slip off and fire accidentally. During intentional firing of the bowstring, the retainer smoothly and effortlessly moves to the unlocked position to allow the sudden release of the bowstring and automatically returns to the locked position after firing. The device can be easily held in one hand and fully manipulated to the open and locked position, is simple to construct and can be triggered by slight movement of the thumb or finger in a readily reproducible manner. The novel trigger components comprise the lever arm, coupler(s), biasing spring and retainer bar limit means, are essentially wear-free and are interconnected in the housing for maximum efficiency. The device provides improved smoothness of operation and safety over prior art devices. Its trigger pull and feel can be finely adjusted for improved shooting and it is particuarly adapted for maximum ease and efficiency in bow hunting. Various other features are set forth in the following detailed description and the accompanying drawings.

DRAWINGS

DETAILED DESCRIPTION

Figure 1:
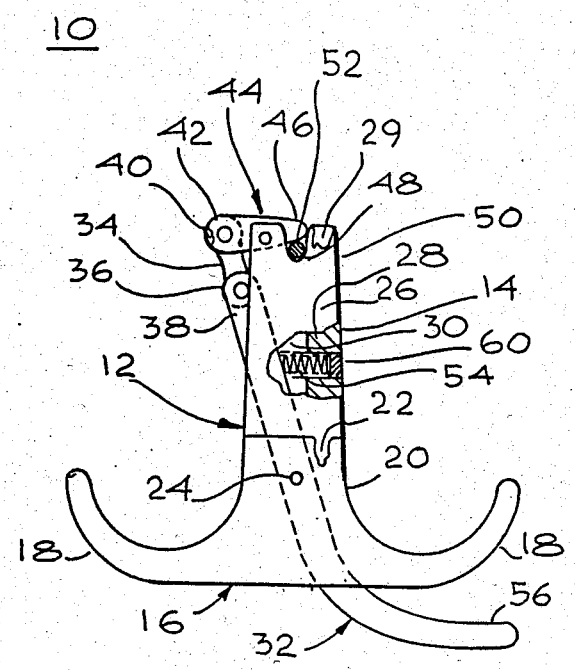
FIG. 1 is a schematic top plan view, partly broken away, of a first preferred embodiment of the improved release device of the invention in a locked position around a bowstring.
Figure 2:
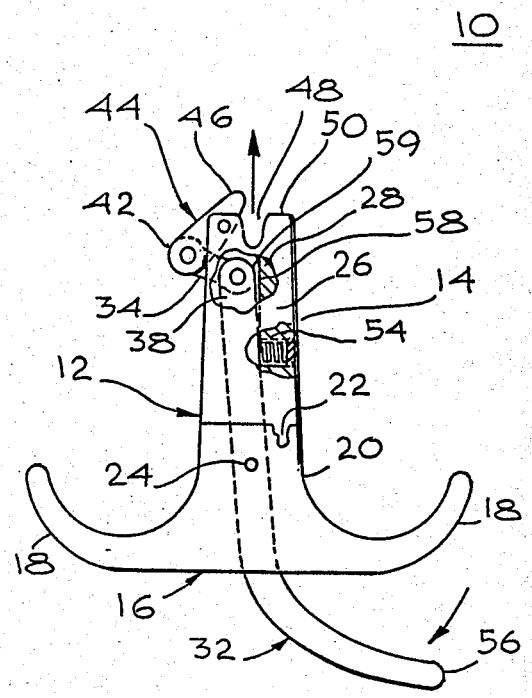
FIG. 2 is a schematic top plan view, partly broken away, of the device of FIG. 1 in an unlocked position just after release of the bowstring and before automatic return to the locked position of FIG. 1.

FIGS. 1 and 2

Now referring more particularly to FIGS. 1 and 2, a first preferred embodiment of the improved release device of the present invention is schematically depicted therein. Thus, device 10 is shown which comprises an elongated housing 12 comprising a generally cylindrical forwardly extending front portion 14 and a generally transversely extending rear portion 16. Portion 16 is contoured to provide a pair of finger-receiving wings 18 and a central forwardly extending cylindrical tube 20 slip fitted over the cylindrical rear end 22 of portion 14 and pinned in place, as at point 24.

Cylindrical portion 14 comprises a pair of generally vertically spaced flanges 26 joined on one side thereof by a web 28 and at the front end thereof by a vertical web 29, so as to define a space 30. Within space 30 are disposed in longitudinal sequence from rear to front, a trigger lever arm 32 pivotally secured adjacent its midpoint, as at point 24, to flanges 26 and extending rearwardly and laterally of housing 12, a link 34 pivotally secured adjacent its rear end 36 to the front end 38 of arm 32 and at its front end 40 to the rear coupling end 42 of an elongated retainer bar 44.

Retainer bar 44 is also pivotally connected at about its midpoint to flanges 26. The opposite retaining end 46 of retainer bar 44, when in the locked bowstring-retaining first position shown in FIG. 1, extends into an opening 48 in the front end 50 of housing 12, specifically in the front end of space 30. In this position, retainer bar 44 is transverse of portion 14, that is, is at an angle to link 34 and front end 38 of trigger arm 32 such that retaining end 46 cannot rotate forward to release bowstring 52. Thus, end 46 securely locks and holds bowstring 52, allowing the archer to easily draw it rearwardly to the full draw position without danger of slipping of bowstring 52 from device 10. So long as trigger arm 32 is not moved, as by the archer's finger or thumb, spring 54, secured in portion 14 between flanges 26 and transverse of housing 12, keeps end 38 of trigger arm 32 urged into the locked position. Thus, spring 54 bears transversely against end 38, as shown in FIGS. 1 and 2.

In order to release bowstring 42, after fully drawing the same and aiming an arrow attached thereto, the archer urges the rear end 56 of arm 32 rearwardly and transversely, causing the front end 38 of arm 32 to rotate against spring 54, in turn rotating the rear end 36 of link 34 generally in the same direction but out of alignment with arm 32. Retainer bar 44 is, in turn, rotated so that end 46 moves from the transverse bowstring-holding locked position of FIG. 1 to the unlocked fired position of FIG. 2. During this rotation, bowstring 52 slips from end 46 and is suddenly released, firing an arrow disposed thereon.

It will be understood that so long as link 34 is in line with arm 32 (FIG. 1), force applied to end 46 of retainer bar 44, such as the force applied by the drawn bowstring 52, cannot cause bar 46 to rotate. It is only when arm 32 is moved, as described above, so that link 34 comes out of direct alignment therewith, that the bowstring force on end 46 can smoothly and rapidly allow end 46 to be rotated forward to effect the desired bowstring release. It will also be understood that the extent of rotational movement of end 38 of arm 32 is limited by its engagement with that portion 58 (FIG. 2) of housing defining space 30 adjacent end 32 so that bar 44 cannot be pivoted sufficiently far to prevent the biasing action of spring 54 on end 38 from automatically rotating bar 44 to the locked position of FIG. 1. Thus, limit means 59 is provided. After release of bowstring 52 (FIG. 2), spring 54 automatically drives end 38 of arm 32 into the locked position of FIG. 1 to place link 34 and end 38 into alignment. No finger pressure whatever need be applied to end 46 to cause it to rotate to the locked position of FIG. 1. Single finger rearward movement of end 56 of arm 32 gradually opens bar 44 against the bias of spring 54 while device 10 is held in one hand, thus enabling the archer-hunter to easily single handedly lock release 10 to bowstring 52, a decided advantage over conventional release devices.

The degree of force needed to be applied to the rear end of arm 32 to cause it to move sufficiently far to cause the firing of the trigger mechanism (release of bowstring 52) can be regulated through adjustment of limit spring 54 in space 30 as by adjustment screw 60.

FIG. 3

Figure 3:
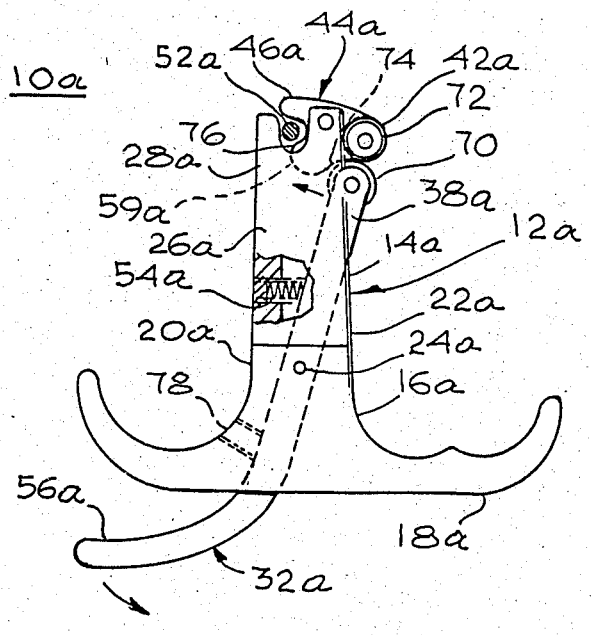
FIG. 3 is a schematic top plan view, partly broken away, of a second preferred embodiment of the device of the present invention in the locked position around a bowstring; and, FIG. 4 is a schematic top plan view, partly broken away, of a third preferred embodiment of the device of the present invention in the locked position.

A second preferred embodiment of the improved release device of the present invention is schematically depicted in FIG. 3. Thus device **10*a* is shown which is similar to device 10 in appearance and function. Components thereof similar to those of device 10 bear the same numerals but are succeeded by the letter "a". Device 10*a* differs from device 10 only in the following respects. One wing 18*a* is elongated and contoured to provide a rest for two fingers. Moreover, link 34 is absent. Instead, end 38*a* bears a roller 70 rotatably secured thereto while end 46*a* bears a similar roller 72 rotatably secured thereto and abutting roller 70. Moreover, end 46*a* includes a curved camming surface 74 engageable with roller 70 and a curved limit surface 76 engageable with web 28*a* to act as limit means 59*a*, preventing over rotation of bar 44*a*. Surface 74 is engaged by roller 70 during movement of end 56*a* of arm 32*a* rearwardly, causing rotation of bar end 46*a* until release of bowstring 52*a* occurs, whereupon bar 44*a* returns to the locked position of FIG. 3. Moreover, a limit screw 78 is provided rearward of point 24*a* to permit fine tuning of device 10*a***.

FIG. 4

Figure 4:
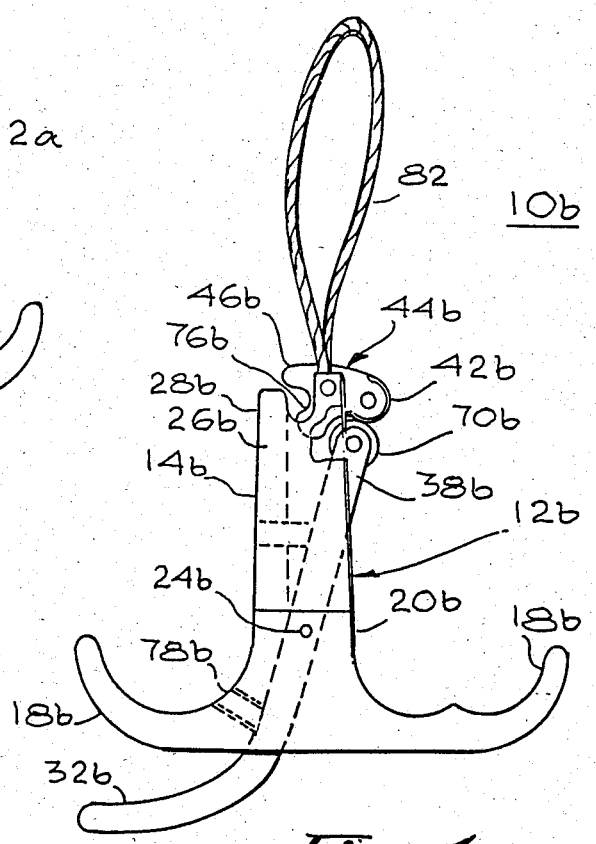

A third preferred embodiment of the improved present release device is schematically depicted in FIG. 4. Thus, device **10*b* is shown, substantially identical to device 10*a*, with similar components thereof bearing the same numerals but succeeded by the letter "b". Device 10*b* differs from device 10*a* by including a closed string loop 82 and by having no roller 72, but instead a hardened curved bearing surface 42*b* against which roller 70*b* bears and slides. Otherwise, the function of devices 10*a* and 10*b*** is identical.

The described improved release device of the present invention can be fabricated of metal and/or other suitable components and has been found in practice to be durable, inexpensive and highly efficient, particularly for hunting purposes. Various modifications, changes, alterations and additons can be made in the present device and its components and parameters. All such modifications, changes, alterations and additions as are within the scope of the appended claims form part of the present invention. It is understood that all components shown may be interchangeably used in all preferred embodiments.

What is claimed is:

1. An improved mechanical bowstring release device automatically biased to the locked position, said device comprising, in combination:

a. a hollow housing having a longitudinal space therein extending to the front end thereof;

b. a bowstring retainer pivotally secured in said space and including a bowstring-retaining end extending transversely into and terminating in said housing at the front end of said space and pivotable between a locked bowstring-retaining first position blocking the front end of said space to trap said bowstring in said space and an unlocked bowstring-releasing space-opening second position, said retainer also including a coupling end extending laterally of said housing; and, c. trigger means for locking said retainer in said first position and for urging said retainer into said unlocked second position to release said bowstring, said trigger means being:

i. an elongated lever arm pivotally secured in said space, the rear end of said arm curving rearwardly of said housing, the front end of said lever arm positioned generally rearwardly of and adjacent said coupling end of said retainer, ii. coupling means connected to and positioned between said coupling end of said retainer and said front end of said lever arm, said coupling means comprising a roller rotatably secured to the front end of said lever arm, a second roller on said retainer coupling end slideably engaging said first roller and wherein a curved camming surface on said retainer coupling end is provided adjacent said first roller, said coupling means extending out of said housing and rotatable generally transversely with the front end of said lever arm into said housing and into said unlocked position;

iii. a biasing spring in said frame bearing against said lever arm to urge said first roller into contact with said second roller to bias said retainer into said locked position; and, iv. retainer movement limit means in said housing preventing rotational movement of said retainer into an unlocked position.

2. The improved release device of claim 1 wherein said device includes a lever arm limit screw in said housing behind said lever arm pivot point.

3. The improved release device of claim 2 wherein said limit screw and said biasing spring are adjustable and generally transverse of said housing, said biasing spring being forward of said pivot point in said space.

4. The improved release device of claim 1 wherein said device includes a bowstring draw cord in the form of a closed loop secured to said housing and extending forwardly thereof.

5. The improved release device of claim 1 wherein said retainer movement limit means comprises a surface of said retainer engageable with the surface defining said opening to prevent further over rotation of said retainer.

* * * * *